United States Patent [19]

Vendelin et al.

[11] Patent Number: 4,896,838

[45] Date of Patent: Jan. 30, 1990

[54] ROTOR FOR VERTICAL SHAFT IMPACT CRUSHERS

[75] Inventors: John C. Vendelin; Frederick J. Winegar, both of Springfield, Oreg.

[73] Assignee: Cedarapids, Inc., Cedar Rapids, Iowa

[21] Appl. No.: 264,983

[22] Filed: Oct. 31, 1988

[51] Int. Cl.[4] ..... B02C 19/00

[52] U.S. Cl. ..... 241/275

[58] Field of Search ..... 241/275.5, 300, 197, 241/183, 182

[56] References Cited

U.S. PATENT DOCUMENTS

| | | |
|---|---|---|
| 3,174,697 | 3/1965 | Bridgewater . |
| 3,346,203 | 10/1967 | Danyluke . |
| 3,606,182 | 9/1971 | Warren . |
| 3,970,257 | 7/1976 | MacDonald et al. . |
| 4,065,063 | 12/1977 | Johnson . |
| 4,090,673 | 5/1978 | Ackers et al. . |
| 4,174,814 | 11/1979 | Warren et al. . |
| 4,577,806 | 3/1986 | Terrenzio . |
| 4,690,341 | 9/1987 | Hise et al. . |
| 4,796,822 | 1/1989 | Terrenzio . |

*Primary Examiner*—Mark Rosenbaum

*Attorney, Agent, or Firm*—Simmons, Perrine, Albright & Ellwood

[57] ABSTRACT

A rotor for a vertical shaft impact crusher features a unique protector for the trailing edge of each material exit portal of the crusher. The portal protector includes upper and lower "wings" between which is a channel. The wings and channel trail outwardly from the portal and along the periphery of the rotor to create a pair of trailing vortices which confine the exiting material to the periphery of the rotor in order to prevent the material from also spilling over the upper and lower edges of the portal and onto the top of the rotor, thus reducing wear. The peripheral wall of the rotor is protected by symmetrical shell segments having upper and lower lips. Each of the latter is engaged in turn by a symmetrical, segmented rim liner fashioned so that a shell segment can be replaced or moved to even-out wear simply by removing one of its associated segmented rim liners.

17 Claims, 6 Drawing Sheets

FIG 5
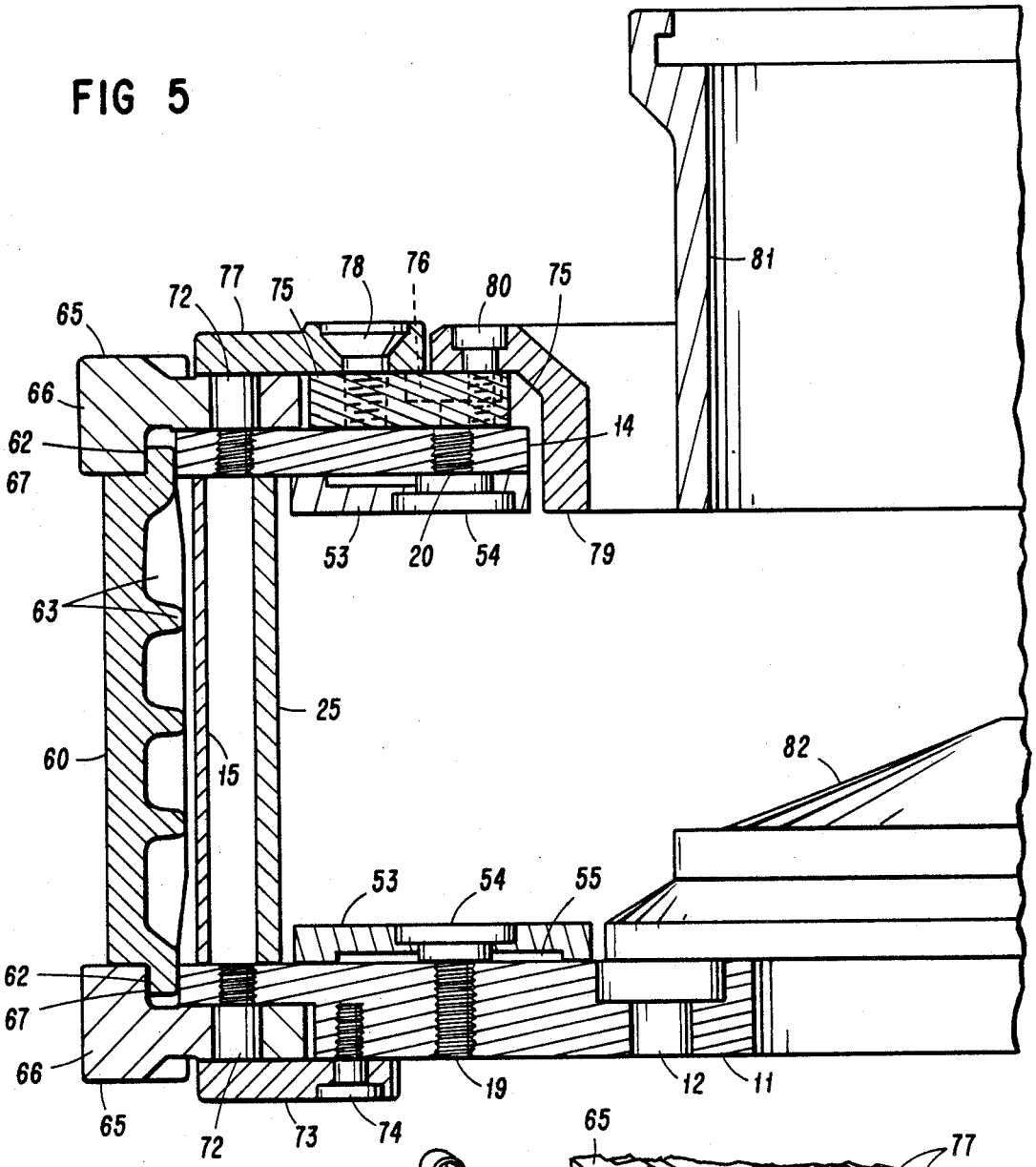
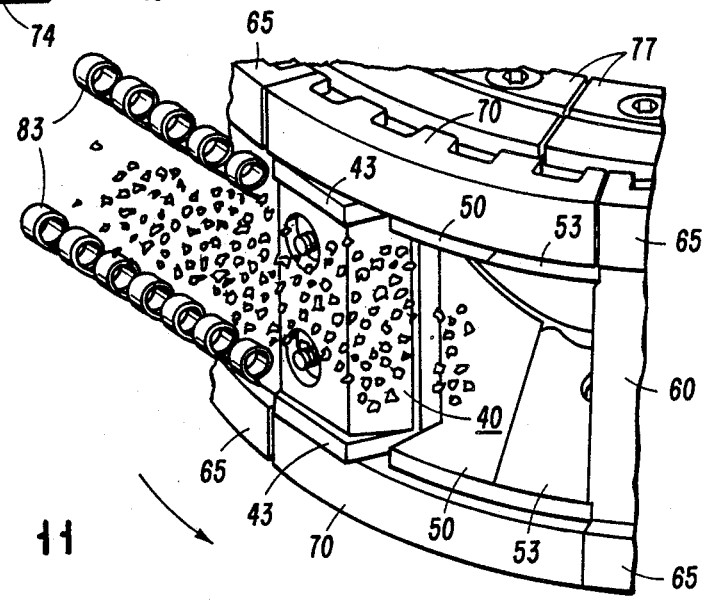
FIG 11

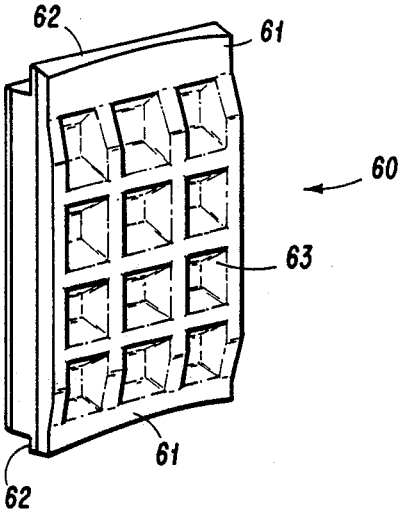
FIG 8
FIG 9
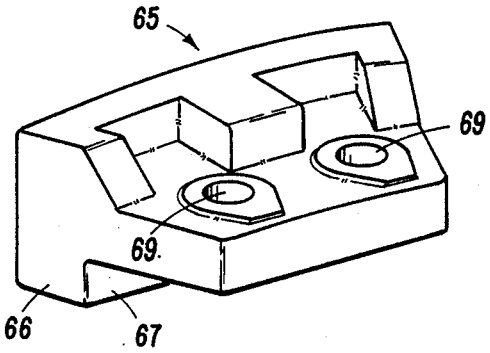
FIG 10
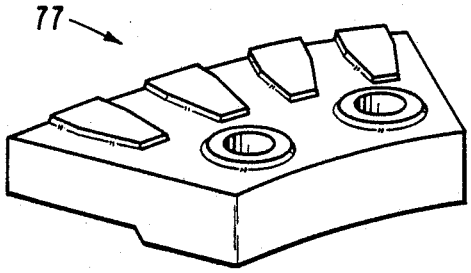
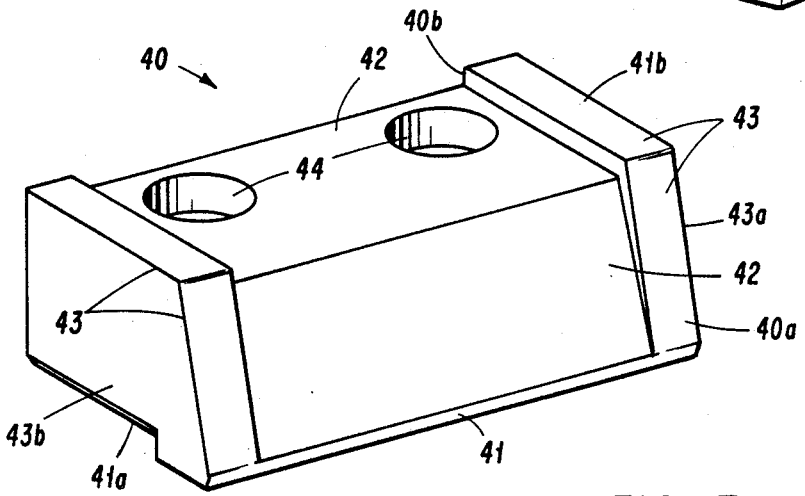
FIG 7

ROTOR FOR VERTICAL SHAFT IMPACT CRUSHERS

BACKGROUND OF THE INVENTION

The instant invention concerns vertical shaft impact crushers and particularly the rotors for same.

In a vertical shaft crusher the material descends from a hopper onto the center of a rotor atop a vertical driven shaft. The material is flung radially outwardly by the rotor through exit "portals" in its periphery against an encircling ring of stationary anvils which shatter the material. Alternately, instead of anvils the material strikes an encircling wall of previously crushed material. In either case obviously the rotor itself is subject to substantial wear. This is particularly true in the case of the "open shoe" type rotors, such as those in U S. Pat. Nos. 3,174,697; 3,606,182; 4,065,063; 4,090,673; and 4,577,806, for instance, which require the shoes and associated parts of the rotor to be replaced at fairly regular intervals, usually an expensive and time-consuming job. Another type of rotor consists of a basic cylindrical rotor weldment and collects the material on some of the most exposed surfaces within the rotor weldment in order to shield those surfaces so far as possible from wear. Examples of that approach are found in U.S. Pat. Nos. 3,346,203; 3,970,257; and 4,690,341. The trailing edges of the exit portals are then made replaceable and of hardened material such as carbide, and the upper and lower inner walls of the rotor weldment as well as its periphery are shielded by replaceable liners, all in order to protect the basic rotor weldment.

Even though the rotor designs of the latter three patents reduce the cost of compensating for wear, further improvements to that end in that type of design are desirable, as is the need to reduce as far as possible the time and effort needed to replace the worn parts. These aims are the principal objects of the present invention.

SUMMARY OF THE INVENTION

Insofar as wear is concerned the invention concentrates on the trailing edges of the exit portals themselves and on those edges and surfaces adjacent the trailing edges of the portals which receive the most punishment. The trailing edges of the portals include double carbide tips radially outward of which are "winged exit portal protectors" which are aerodynamically configured to produce upper and lower trailing vortices. The latter confine the exiting material to a peripheral direction only so that it does not fan out and spill over the upper and lower peripheral edges of the portals and the upper exterior surface of the rotor. The cylindrical wall of the rotor weldment between the exit portals is sheltered by replaceable shell segments of wear resistant material held in position by replaceable upper and lower rim liners enclosing the upper and lower edges or rims of the rotor weldment and its upper and lower exterior surfaces.

The shell segments are of uniform size and the upper rim liners are also fashioned in uniform segments whose peripheral width is equal to that of the shell segments. Hence an individual shell segment can be replaced simply by removing its associated upper rim liner, in contrast to previous rotors of the design concerned in which a full annular retaining member must be removed in order to replace one or more shell segments. This is important from the standpoint of "down time" of the crusher because of the uneven wear of the shell segments encountered during typical crusher operation, the wear increasing in a trailing direction from each exit portal.

Other and further features and advantages of the present invention will be apparent from the drawings and the more detailed description which follows.

BRIEF DESCRIPTION OF THE DRAWINGS

FIG. 5 is a sectional view taken approximately along the line 5—5 of FIG. 4.

FIG. 7 is a perspective view of one of the winged exit portal protectors.

FIG. 8 is a perspective view of one of the rotor shell segments.

FIG. 9 is a perspective view of one of the upper rim liners.

FIG. 10 is a perspective view of one of the retainers for the upper rim liners.

FIG. 11 is a detail perspective view illustrating the function of the winged exit portal protectors.

DETAILED DESCRIPTION OF THE PREFERRED EMBODIMENT

Figure 1:
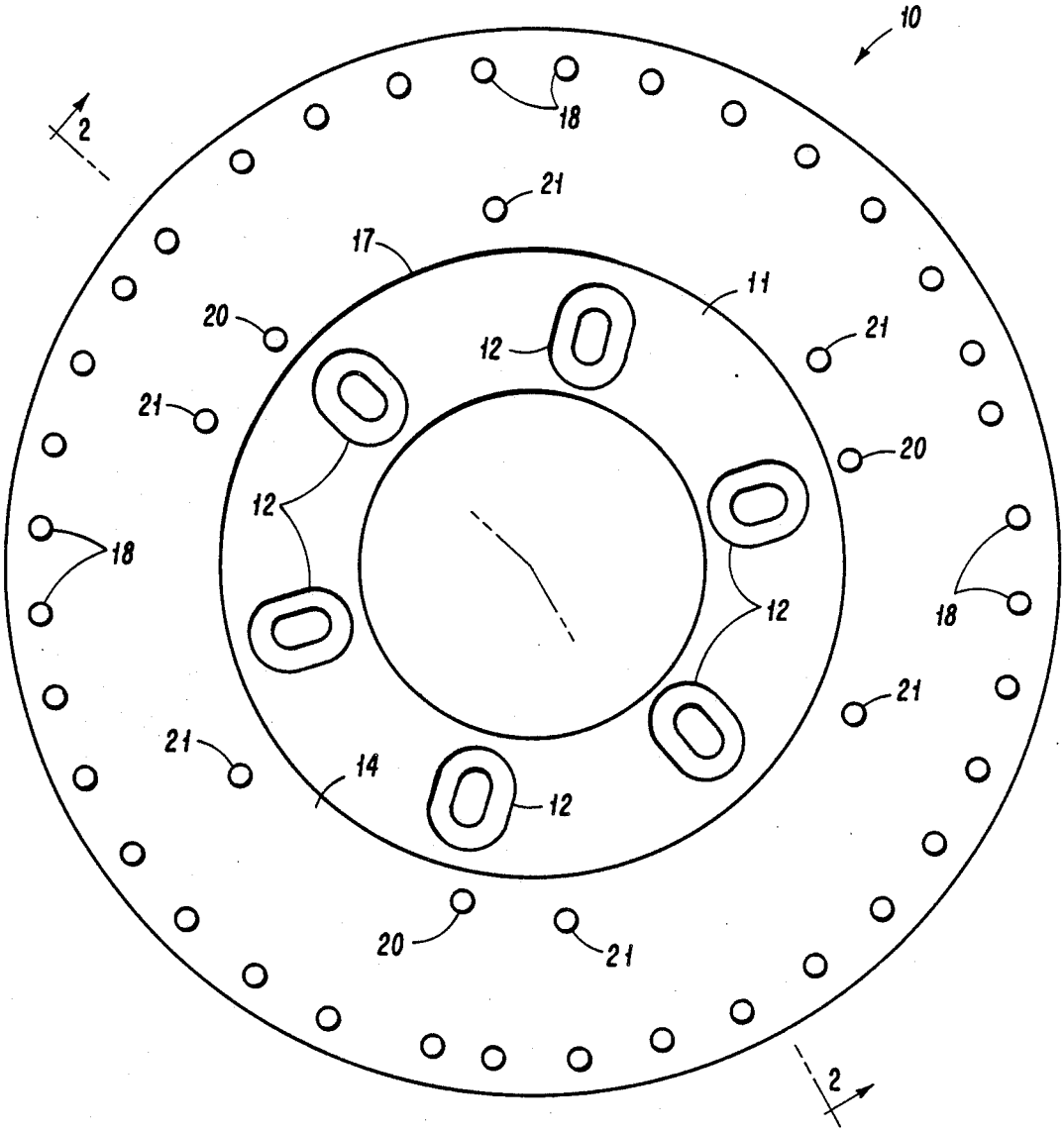
FIG. 1 is a top plan view of the basic rotor weldment.
Figure 3:
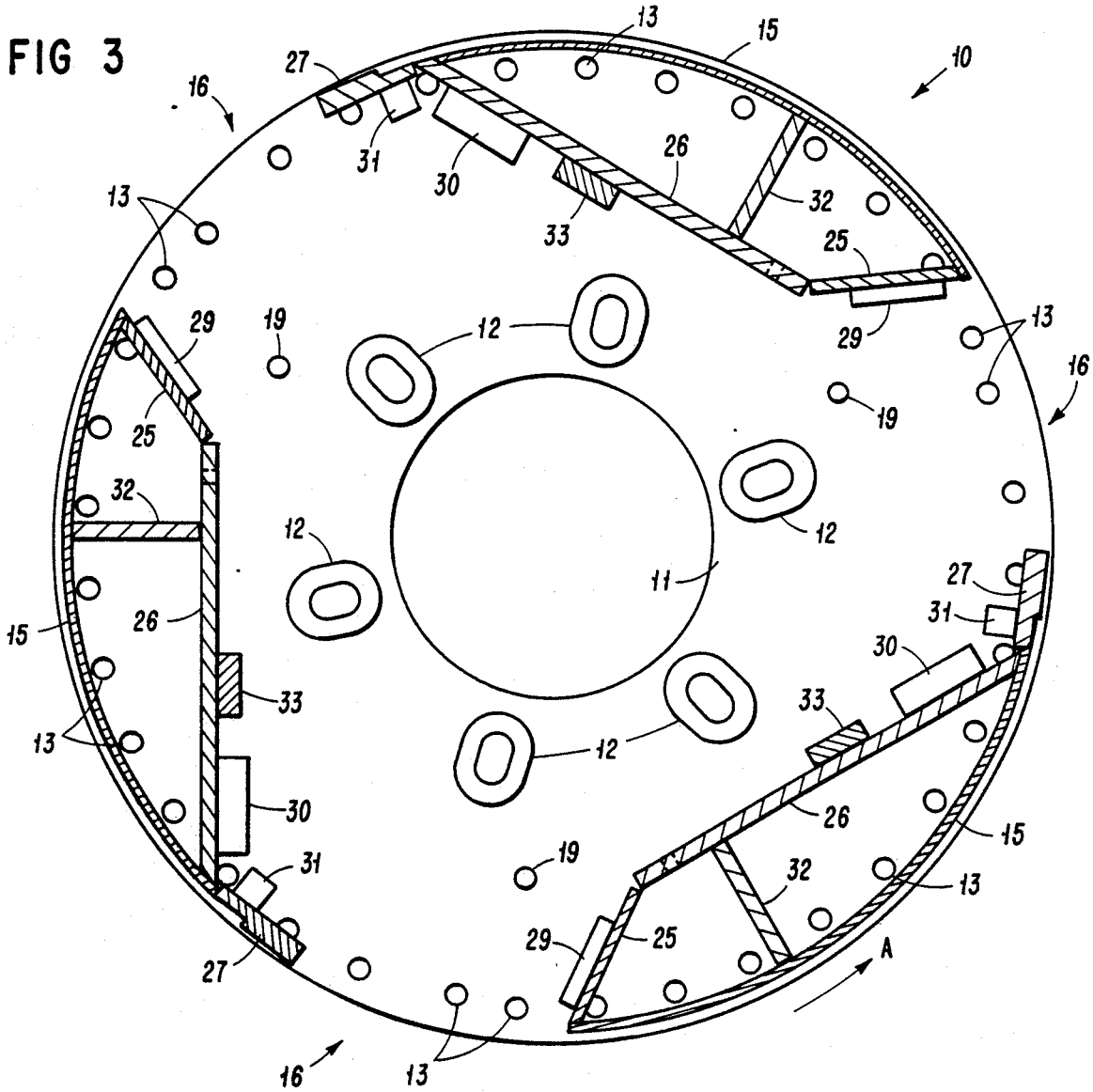
FIG. 3 is a sectional view taken along the line 3—3 of FIG. 2.
Figure 2:
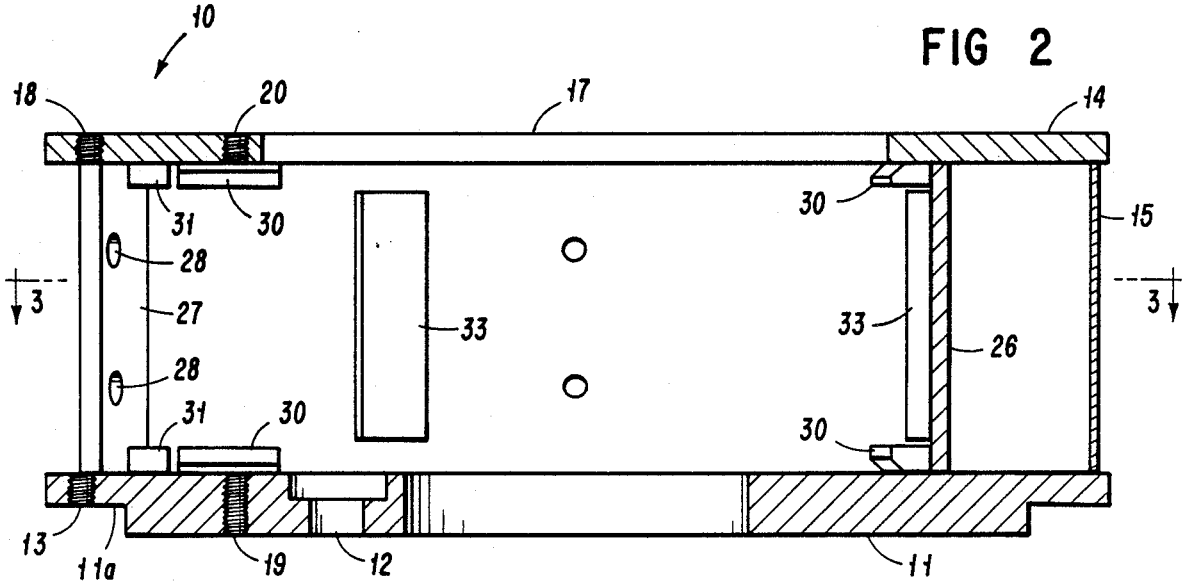
FIG. 2 is a sectional view taken along the line 2—2 of FIG. 1.

The basic rotor weldment 10 depicted in FIGS. 1-3 is formed of mild steel and consists of a heavy lower annular end wall 11 having an inner ring of slotted holes 12 for bolting to the crusher's flywheel (not shown). The outer rim of the end wall is underly shouldered at 11*a* and drilled through to provide a circle of tapped holes 13 for purposes to be described. A thinner upper annular end wall 14 is spaced above the end wall 11 by three symmetrical arcuate side walls 15 about the outer rims of both end walls and interrupted to provide three symmetrical, equally spaced material exit portals 16. A central aperture 17 in the end wall 14 provides an entrance for material into the rotor. The outer rim of the end wall 14 is also drilled through with a circle of tapped holes 18 in alignment with the holes 13 of the end wall 11 below. Inboard of the portals 16 the lower end wall 11 is provided with tapped holes 19 and the end wall 14 with a like number of tapped holes 20 in alignment with the holes 19, all for purposes to be described. The upper end wall 14 is additionally provided with a circle of six tapped holes 21 equally spaced about the opening 17, again for purposes to be described.

The interior of the rotor is fitted with three symmetrically arranged partitions, as shown in FIG. 3, extending between adjacent exit portals 16. Each partition consists of a short wall 25 slanting inwards from the leading edge (with respect to the direction of rotation indicated by the arrow "A" in FIG. 3) of each portal 16 and joined to a longer wall 26 extending therefrom to the trailing edge of the next portal 16 so that the two walls 25 and 26 span one of the side walls 15. From the trailing edge of each wall 26 a short, wear tip mounting wall 27, provided with a pair of vertically spaced holes 28 as shown in FIG. 2, extends peripherally toward the leading edge of its portal 16. Each wall 25, 26, and 27 is further located by upper and lower gusset blocks 29, 30 and 31, respectively, the blocks 30 being underly beveled as indicated in FIG. 2. The walls 26 are further braced by gusset plates 32 running to the adjacent side walls 15 and stiffened by intermediate vertical blocks 33 on their exposed faces.

Figure 4:
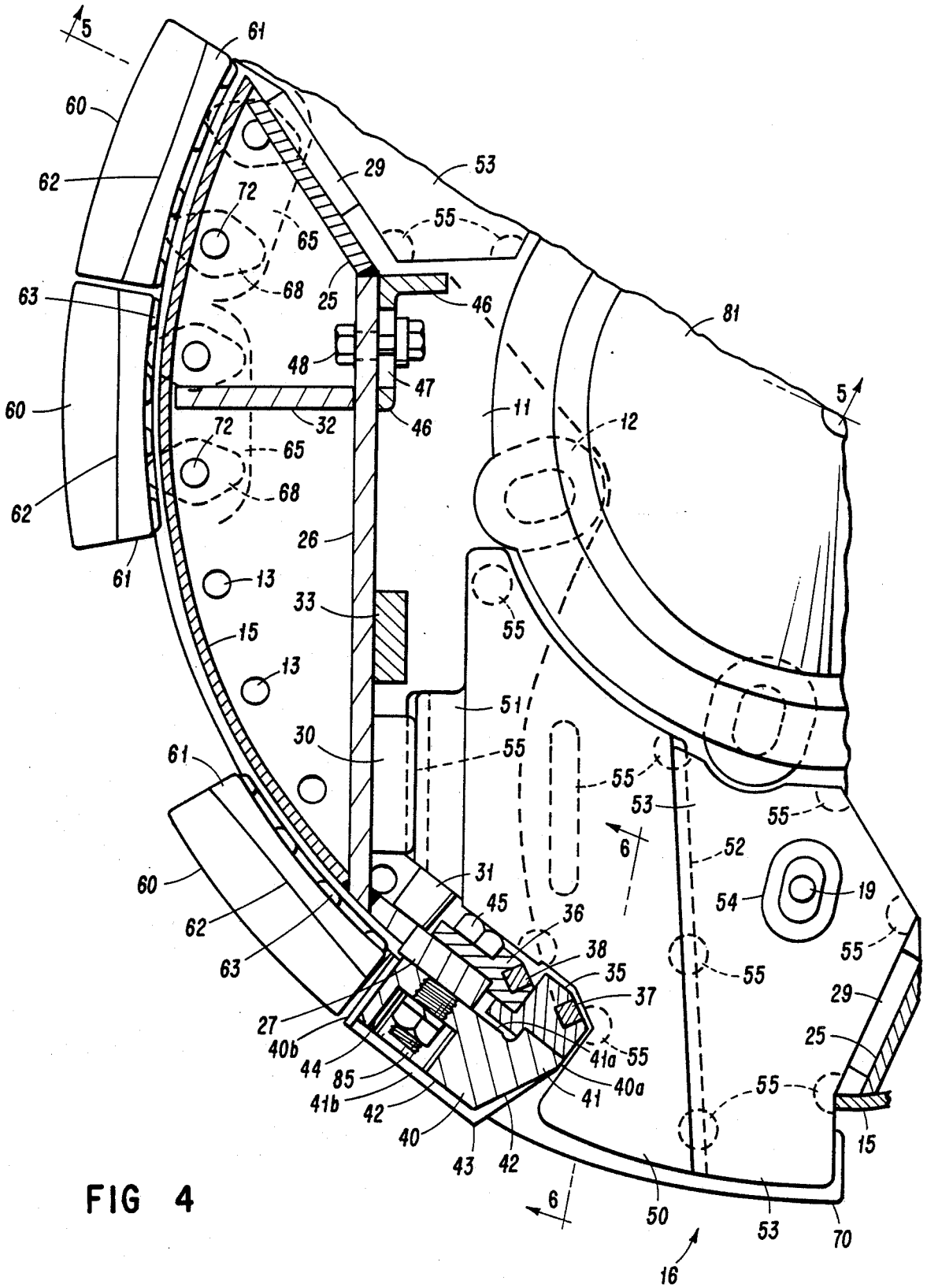
FIG. 4 is a partial sectional view similar to FIG. 3 but illustrating the rotor weldment fitted with its wear resistant components.
Figure 6:
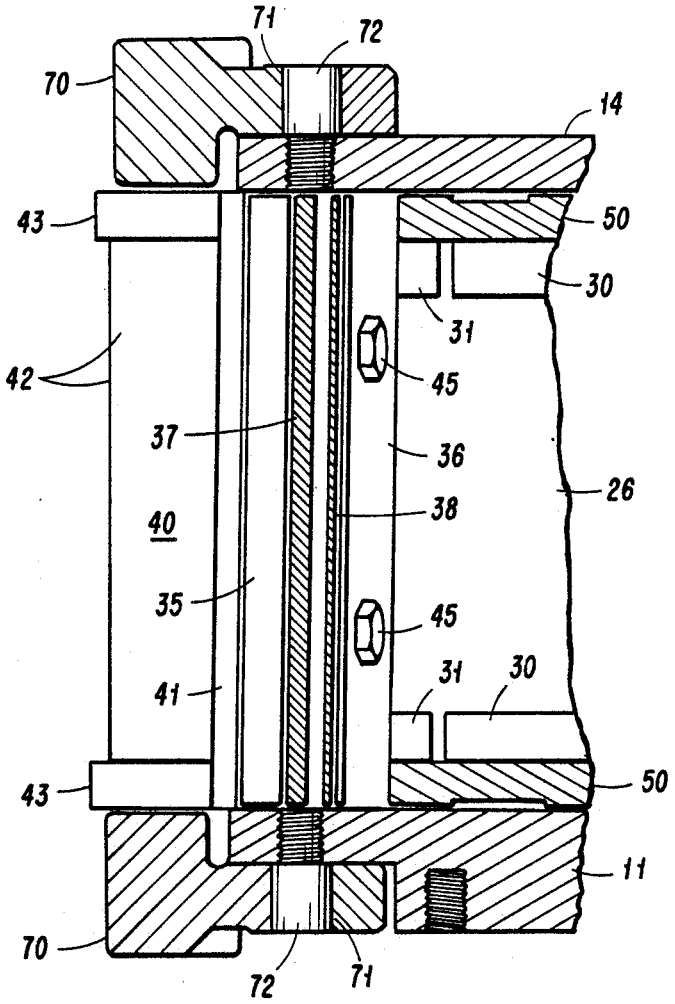
FIG. 6 is a sectional view taken along the line 6—6 of FIG. 5.

The trailing edge of each portal 16 is protected by dual tungsten carbide tips mounted as shown in FIGS. 4 and 6 in configured tip holders 35 and 36 of mild steel, the holder 36 being provided with a pair of vertically spaced holes aligned with those in its wear tip mounting wall 27. The primary wear tips 37 direct flow of material from the exit portals 16 and each is backed up by a trailing, secondary tip 38 in case of failure of the former. Each tip 37 and 38 is a one-piece tungsten carbide square rod that is either silver soldered or bonded with high-strength structural adhesive into angled vertical grooves in the holders 35 and 36. Silver solder is preferred in order to compensate for the difference in thermal expansion between the carbide of the tips and the mild steel of the holders. Prior practice has been to use several short lengths of the carbide material for such tips clasped in the holders inasmuch as a onepiece carbide tip tends to fracture during cooling of the silver soldered assembly. But the joints between the carbide lengths tend to erode and lead to early failure of the tip. Now it has been found that a separate piece of copper foil placed in the joint between a one-piece tip and its holder will compensate for the uneven contraction of the components during the cooling cycle. Experience has shown that the strength of the joint is not compromised by the copper foil.

Radially outward of each pair of tips 37 and 38 is disposed a winged exit portal protector 40 cast of high-chrome white iron for wear resistance and shown in more detail in FIG. 7. Each portal protector 40 has a leading end 40*a* and an opposite trailing end 40*b* and includes a nose 41 at its leading end 40*a* adjacent its inner side wall 41*a* opposite an outer side wall 41*b* from which a flat channel 42 of uniformly increasing depth extends at an acute angle to the inner side wall 41*a* outwardly in a trailing direction to the portal protector's outer side wall 41*b*. The channel 42 thence proceeds uniformly in depth in a trailing direction along the periphery of the rotor to the trailing end 40*b* of the portal protector, thereby creating a pair of upper and lower flanges or "wings" 43 adjacent correspondingly upper wall 43*a* and lower wall 43*b* with respect to the operative disposition of the portal protector 40 on the rotor and, hence, parallel to the rotor weldment end walls 11 and 14. The two tip holders 35 and 36 and the portal protector 40, which is provided with a pair of vertically spaced, counterbored holes 44 aligned with the holes 28 of the tip mounting wall 27, are all held together in assembled relation by a pair of bolts 45 through the wall 27, the tip holder 36 and the portal protector 40, the tip holder 35 being captured and clamped between the holder 36 and the portal protector 40 in the manner shown in FIG. 4.

The trailing end of each inner partition wall 26 is fitted with a vertical trail plate 46, slotted at vertically spaced locations 47 for fore and aft adjustment along the wall 26 by means of a pair of bolts 48. During operation of the crusher material builds up from adjacent the primary tips 37 to the trail plates 46, as roughly indicated by the broken line in FIG. 4, thus protecting the partition walls 26, the wear tip mounting walls 27, the tip holders 36 and the secondary tips 38. The length and contour of the material build-up can be varied by the foregoing adjustment of the trail plate 46. Should one of the primary tips 37 shatter owing to passage of tramp iron, for instance, the secondary tip 38 will protect the adjacent components from what would otherwise be rapid destruction.

The exposed inner surfaces of the lower and upper rotor weldment end walls 11 and 14 are protected in turn by inner primary and retaining plate liners cast from high-chrome white iron, the upper ones being essentially mirror images of the lower ones, which ones only will be described. Each primary liner 50 is configured as shown in FIG. 4 and includes a tongue 51 at one side and beveled at its edge to slip beneath the under bevel of the adjacent gusset block 30. A beveled edge 52 along the opposite side of the liner 50 is overlapped by a mating bevel along the side edge of the retaining liner 53, the latter having a slotted, counterbored hole 54 through which it is bolted into the tapped hole 19 in the lower rotor weldment end wall 11. The two plates 50 and 53 are thus retained by the single bolt (not shown) through the plate 53 for easy and quick replacement of both liners 50 and 53, the primary liner 50 requiring replacement more often than the retainer liner 53. Each liner 50, 53 is also preferably cast with shallow pads 55 which support it on the rotor weldment end wall 11. The upper primary and retaining liners 50, 53 are retained in the same manner by a single bolt threaded up into the holes 20 in the upper end wall 14.

As already mentioned the exterior peripheral side walls 15 of the rotor weldment 10 between the exit portals 16 are girded by replaceable shell segments 60, as shown in FIGS. 4, 5 and 8, cast of high-chrome white iron. The segments 60 are all of equal size and symmetrical construction so as to be interchangeable with each other as well as to be invertible. The outer and inner faces of each segment 60 are generally concentric with the axis of the rotor, and the upper and lower arcuate ends of each segment 60 are provided with retaining lips 61 along the entire arcuate lengths of the two ends and parallel to the rotor's axis. Each lip 61 is provided with an outer planar face 62 which, when the segment is assembled on the rotor, lies in a first plane parallel to the rotor's axis and perpendicular to a second plane through that axis which bisects the segment 60. The rear face of each segment 60 includes integrally cast, stiffening ribs 63 for strength.

The shell segments 60 are retained on the rotor weldment side walls 15 by identical upper and lower rim liners 65, as shown in FIGS. 5, 6 and 9, and also cast from high-chrome white iron. Each rim liner 65 is of sector shape in plan view concentric with respect to the rotor's axis and of an arcuate or peripheral length equal to that of the shell segments 60. The outer peripheral edge of each liner 65 includes a shell segment retaining lip 66 having an inner planar face 67 mating with the face 62 of its associated shell segment 60. Inboard of their retaining lips 66 the rim liners 65 include shallow, integral pads 68 (see FIG. 4) on which they overlie the adjacent edges of the rotor weldment end walls 11 and 14, and are there provided with a pair of smooth bores 69 whose axes are parallel to the rotor's axis and lie on a circle centered on that axis. The rim liner retaining lips 66 capture the retaining lips 61 of the shell segments 60 against the peripheries or rims of the weldment end walls 11 and 14, thus supporting and retaining the segments 60. Note that each segment 60 is retained solely by the mating faces 62 and 67 of the segment and liner lips 61 and 66, the segment ribs 63 standing shy of the rotor weldment side walls 15. The faces 62 and 67 are cast planar for better mating than if cast arcuate. Hence the rims of the rotor weldment end walls 11 and 14 and the weldment side walls 15 between the leading edge of each exit portal 16 and the portal protector 40 of the adjacent portal 16 are completely enclosed by the segments 60 and rim liners 65 for wear protection. A pair of similar rim liners 70 having like bores 71 but of greater peripheral length than the liners 65 (see FIGS. 6 and 11) enclose and protect the exposed upper and lower rims of the weldment end walls 11 and 14 at each exit portal 16, and are overlapped by the other ends of the inner plate liners 50 and 53.

The rim liners 65 and 70 are radially retained by studs 72 parallel to the rotor's axis threaded into the holes 13 and 18 around the weldment end walls 11 and 14. The studs 72 slidably receive the bores 69 and 71 of the rim liners 65 and 70, as shown in FIGS. 5 and 6. The lower rim liners 65 and 70 seat in the lower weldment end wall shoulder 11*a* and are retained on the studs 72 by a single annular retaining plate 73 bolted at 74 up into the end wall 11 (see FIG. 5). An annular spacer plate 75 is disposed inboard of the upper rim liners 65 and 70 and bolted at 76 to the weldment upper end wall 14. An annular surround of segmental rim liner retainers 77 (see FIG. 10) overlie the inboard portion of the upper rim liners 65 and 70 and are bolted at 78 into the outboard portion of the spacer plate 75. The retainers 77 are fewer in number than the rim liners 65 and 70, there being 9 of the former and 15 of the latter on the rotor depicted, so that the retainers 77 overlap adjacent ones of the liners 65 and 70. Finally, an annular feed eye 79 is bolted at 80 to the inboard portion of the spacer plate 75 and spacedly receives a feed tube, the lower part of which is indicated at 81, opening centrally down into the rotor. Below the feed tube is disposed a feed cone 82 which merely sits of its own weight centrally on the weldment lower end wall 11.

The action of the winged exit portal protectors 40 is illustrated in FIG. 11. The wings 43 produce a pair of upper and lower trailing vortices 83 in the manner shown which confine the exiting material to a strictly trailing direction along the periphery of the rotor rather than allowing it also to spill up and over the adjacent upper and lower rim liners 70 as well as onto the top of the rotor, as would be the case were the wings 43 not present. Wear of the rim liners 70 and the top of the rotor is thereby reduced. Removing the two bolts 45 allows replacement of each pair of wear tips 37 and 38 and/or the exit portal protector 40, and removing the single bolt retaining each set of inner upper or lower plate liners 50, 53 allows quick replacement of the primary liner 50 as well as, when necessary, the retaining liner 53. Simply by removing an adjacent pair or two of the segmented upper rim liner retainers 77 and sliding the rim liners 65 and/or 70 off their studs 72, one or more of the shell segments 60 between the exit portals 16 can be replaced or inverted or rearranged, since they are all symmetrical, to even-out wear, all without need in many instances of unbolting an entire annular retainer as is typical in prior art constructions. Other aspects of the rotor and its construction will be apparent to those of skill in the art.

Though the present invention has been described in terms of a particular embodiment, being the best mode known of carrying out the invention, it is not limited to that embodiment alone. Hence the following claims are to be read as encompassing all adaptations and modifications of the invention falling within its spirit and scope.

We claim:

1. In a rotor for a vertical shaft impact crusher, the rotor having a generally annular side wall disposed between a pair of generally circular plates defining axially spaced upper and lower end walls of the rotor when in operation, the upper rotor end wall including a central aperture therein for receipt into the interior of the rotor of material to be crushed, the side wall of the rotor including a plurality of material exit portals from the interior of the rotor uniformly spaced about its periphery, each exit portal having leading and trailing edges with respect to the direction of operative rotation of the rotor and extending between the rotor upper and lower end walls, the improvement comprising: an exit portal protector of wear resistant material constituting both the radially outermost portion of the trailing edge of each exit portal between the upper and lower rotor end walls as well as a portion of the periphery of the rotor in a trailing direction from the trailing edge of the portal, each portal protector having a leading nose disposed radially inwards of the periphery of the rotor and a channel disposed generally parallel to the rotor upper and lower end walls, the channel extending from said nose outwards in a trailing direction with respect to the operative rotation of the rotor to the periphery of the rotor and thence in the trailing direction generally along the periphery of the rotor.

2. The rotor of claim 1 wherein said channel is partially formed by upper and lower flanges adjacent and generally parallel to the rotor upper and lower end walls.

3. The rotor of claim 2 wherein the remainder of said channel is formed by first and second planar surfaces between said flanges, the first surface extending from said nose in said trailing direction outwards to the periphery of the rotor and the second surface extending from the first surface in said trailing direction along the periphery of the rotor.

4. The rotor of claim 3 wherein the depth of said channel uniformly increased in said direction from said nose to adjacent the periphery of the rotor and thence uniformly in depth therefrom in said direction along the periphery of the rotor.

5. An exit portal protector for the trailing edges of the exit portals of the rotor of a vertical shaft impact crusher, the protector comprising an integral casting of wear resistant material having opposite leading and trailing ends, opposite inner and outer side walls, and opposite upper and lower walls with respect to its operative disposition of the rotor, the inner side wall being disposed at an acute angle with respect to a flat channel extending from a substantially linear nose disposed between the upper and lower walls at the leading end of the portal protector in a direction towards the outer side wall, the channel then extending in and along the outer side wall to the trailing end, the protector further including means for securing same to the rotor.

6. The protector of claim 5 wherein said channel is partially formed by upper and lower flanges formed along the upper and lower walls, the remainder of the channel being formed by first and second planar surfaces, the first surface extending from said nose to adjacent the outer side wall and the second surface extending from the first surface along the outer side wall, the first and second surfaces forming an obtuse angle with each other.

7. The protector of claim 6 wherein the depth of said channel uniformly increases from said nose to adjacent the outer side walls and thence uniformly in depth to the trailing end.

8. In a rotor for a vertical shaft impact crusher, the rotor having a generally annular inner side wall disposed between a pair of circular plates defining upper and lower axially spaced end walls of the rotor when in operation, the upper end wall having a central aperture therein for receipt into the interior of the rotor of material to be crushed, said rotor side wall including a plurality of material exit portals from the interior of the rotor uniformly spaced about its periphery, wear resistant protective means for the exterior of said rotor side wall between the material exit portals, the protective means including a plurality of interchangeable arcuate shell segments forming the exterior side wall of the rotor between said portals and means for attaching the shell segments to the rotor, the improvement wherein the attaching means for each shell segment comprises a duplicate retaining lip at each arcuate end of the shell segment, each lip extending in directions both parallel to the axis of the rotor and along substantially the entire peripheral length of the shell segment; and upper and lower shell segment retainers releasably secured relative to the exterior of the rotor upper and lower end walls adjacent their peripheries, the shell segment retainers extending radially therefrom effective so that the retaining lips of each shell segment are captured between the shell segment retainers and the periphery of the rotor upper and lower end walls, at least the upper segment retainers including arcuate cast segmental members having a peripheral length substantially equal to the peripheral length of the shell segment lips and disposed substantially peripherally coincidental therewith, whereby removal of one of the shell segmental retainers permits removal of its associated shell segment.

9. The rotor of claim 8 wherein the shell segments and the shell segment retainers are cast of wear resistant material and the shell segment retainers form the uppermost and lowermost portions of the exterior side wall of the rotor between the shell segments, the retainers thereby also constituting rim liners enclosing the peripheries of the rotor upper and lower end walls to provide wear protection therefor.

10. The rotor of claim 9 including retaining studs for each rim liner extending from the exterior faces of the rotor upper and lower end walls adjacent their peripheries in directions parallel to the axis of the rotor, each rim liner having apertures therethrough for slidably receiving its respective retaining studs effective to locate the rim liners against movement radially of the rotor; and a pair of annular rim liner retainers respectively overlapping tee radially inner portions of the upper and lower rim liners and secured to the rotor effective to prevent movement of the rim liners in directions parallel to the axis of the rotor, the rim liner retainer for the upper rim liners being constituted by a plurality of arcuate segments fewer in number than the upper rim liners.

11. The rotor of claim 10 wherein each shell segment is rectangular in plan view and the inner radial face thereof is spaced from the outer face of the rotor inner side wall effective so that the shell segment is retained against radially inward movement relative to the rotor by its retaining lips.

12. An integrally cast symmetrical shell segment of wear resistant material for protecting the exterior of peripheral side walls of a cylindrical rotor of a vertical shaft impact crusher, the peripheral side walls of the rotor extending between upper and lower annular end walls of the rotor, the segment being generally rectangular and having a pair of radially inner and outer walls of arcuate shape concentric with and adapted to be disposed adjacent an exterior surface of the peripheral side walls between the periphery of the upper and lower end walls, opposite arcuate ends of the segment to be disposed adjacent the peripheries of the upper and lower end walls of the rotor defining retaining lips for the segment having radially inner and outer faces, the retaining lips being disposed along the arcuate length of the segment and extending from the segment in directions to the upper and lower end walls along substantially the entire arcuate length of said ends, the radially outer faces of the lips being planar in a plane perpendicular to a plane through the axis of the rotor to mate with planar inner faces of shell segment retainers, the radially inner faces being arcuate and adapted to be retained against the peripheries of the upper and lower end walls by the shell segment retainers, and for spacing the radially inner wall of the segment from contact with the adjacent exterior surface of the peripheral side wall when the shell segment retainers engage the lips of the shell segment.

13. A rotor for a vertical shaft impact crusher, the rotor including a weldment of upper and lower axially spaced annular end walls each having an outer rim, a plurality of arcuate side walls equally spaced along the outer rim of the annular end walls, spaces between such side walls defining equally spaced material exit portals, and means for protecting the exterior of the rotor, comprising:

means for protecting the outer rim of the lower annular end wall;

means for securing the lower outer rim protecting means to the lower annular end wall;

means for protecting the outer rim of thee upper annular end wall;

means for securing the upper outer rim protecting means to the upper annular end wall;

means for protecting an edge of each of the side walls defining trailing edges of the respectively adjacent exit portals; and a plurality of replaceable shell segments, each segment having outer and inner faces of an arcuate length for disposition along the outer rim between the upper and lower end walls, each of the shell segments having upper and lower arcuate ends provided with retaining lips disposed, respectively, along the upper and lower ends, each lip having an outer planar face, the lips extending from the upper and lower ends into engagement with the protecting means for the outer rims of the upper and lower annular end walls, such engagement retaining each of the shell segments by such upper and lower lips against the outer rims of the upper and lower walls of the rotor and spaced from the adjacent sided walls.

14. A rotor according to claim 13, wherein the means for protecting the outer rim of the upper end wall and the means for protecting the outer rim of the lower end wall comprise a plurality of upper and lower sectorial rim liners, each of the rim liners having a shallow pad adapted to overlie a respectively adjacent edge of outer surfaces of the upper and lower end walls of the rotor, each of the rim liners including means for engaging respective retaining means in the outer surfaces of the upper and lower end walls and, upon engagement with the retaining means, for restraining movement of the rim liners in the plane of the upper and lower end walls.

15. A rotor according to claim 14, wherein the upper and lower sectorial rim liners include first type rim liners overlying portions of the outer rims of the upper and lower end walls adjacent the side walls and second type rim liners overlying portions of the outer rims of the upper and lower end walls adjacent the spaced material exit portals, the first type rim liners having a peripheral length equal to the arcuate length of the shell liners, the means for protecting the outer rims of the upper and lower end walls including outer peripheral edges of each first type rim liner, the outer peripheral edge of each first type rim liner including a retaining lip having an inner face mating with an outer face of a respective retaining lip of one of the shell segments for retaining the respective shell segment thereby against an adjacent one of the outer rims.

16. A rotor according to claim 15, wherein the first type upper rim liners are identical to the first type lower rim liners and the second type upper rim liners are identical to the second type lower rim liners.

17. A rotor according to claim 16, wherein the shell segments are symmetrical and of equal size, such that each shell segment is invertible and interchangeable with each other shell segment and the portions of the side walls of the rotor between each leading edge of the material exit portals and the portal protector are completely enclosed by the shell segments and first type rim liners.

* * * * *